US007380506B2

(12) United States Patent
Hammarstrand

(10) Patent No.: US 7,380,506 B2
(45) Date of Patent: Jun. 3, 2008

(54) SLEEPER-MOVING ARRANGEMENT

(75) Inventor: Ove Hammarstrand, Hudiksvall (SE)

(73) Assignee: Rosenqvist Gruppen AB, Hudiksvall (SE)

( * ) Notice: Subject to any disclaimer, the term of this patent is extended or adjusted under 35 U.S.C. 154(b) by 399 days.

(21) Appl. No.: 10/556,290

(22) PCT Filed: May 10, 2004

(86) PCT No.: PCT/SE2004/000708

§ 371 (c)(1),
(2), (4) Date: Nov. 9, 2005

(87) PCT Pub. No.: WO2004/099504

PCT Pub. Date: Nov. 18, 2004

(65) Prior Publication Data

US 2007/0003402 A1 Jan. 4, 2007

(30) Foreign Application Priority Data

May 12, 2003 (SE) ..... 0301367

(51) Int. Cl.
*E01B 29/00* (2006.01)

(52) U.S. Cl. ..... 104/6; 104/2

(58) Field of Classification Search ..... 104/2, 104/3, 4, 5, 6, 7.1, 7.2, 9; 414/339, 501
See application file for complete search history.

(56) References Cited

U.S. PATENT DOCUMENTS 3,473,482 A * 10/1969 Pouget ..... 104/6
5,243,918 A 9/1993 Bounds
5,361,704 A 11/1994 Bounds

FOREIGN PATENT DOCUMENTS

GB 2 166 474 A 5/1986
WO 99/24668 A1 5/1999

OTHER PUBLICATIONS

International Search Report dated Aug. 5, 2004.

* cited by examiner

*Primary Examiner*—Lars A Olson
(74) *Attorney, Agent, or Firm*—Buchanan Ingersoll & Rooney PC

(57) ABSTRACT

The present invention relates to an arrangement for gripping and releasing a plurality of sleepers intended for a railroad section with the aid of a unit, the arrangement including means for spacing adjacent units equidistantly. The means includes frame-associated and centrally pivotal arms whose outer portions co-act pivotally with one end of a respective brace or link whose other ends are pivotally fastened to a respective outer unit, wherein the central regions of the arms are pivotally fastened to one end of a respective brace or link whose other ends are pivotally fastened to a respective intermediate unit.

20 Claims, 7 Drawing Sheets

SLEEPER-MOVING ARRANGEMENT

TECHNICAL FIELD

The present invention relates generally to an arrangement that enables a plurality of closely related and adjacent oriented sleepers to be moved from a sleeper assembly in the form of a stock or a stack and distributed to and along a railroad bed or a prepared track containing embankment.

The arrangement includes a chosen number of coordinated units, each of which comprises a beam construction or beams having end-related gripping means, hereinafter referred to as gripping claws, wherein pairs of gripping claws are adapted to grip or to grip and hold a sleeper in a first position, and to release the thus held sleeper in a second position.

The invention finds particularly suitable application with regard to moving a plurality of mutually parallel loosely positioned and closely adjacent sleepers from a sleeper stock or stack, by gripping and positioning a chosen number of said sleepers simultaneously with the aid of a corresponding number of arrangement-associated units, where said sleepers are lifted from the sleeper stock, wherein said units are moved away from one another, with the gripped sleepers depending therefrom, to a predetermined position in which the sleepers are lowered onto the railroad bed or containment embankment and loosened so as to rest on said bed.

The arrangement includes to this end a unit-related means, which is adapted to enable the relative distance between said units to be either increased or decreased.

Beam-end-related pairs of gripping claws function to enable a sleeper to be held firmly by means of an end-orientated clamping effect.

More particularly, said means and said chosen number of units are coordinated in a frame structure, wherein, when in a mutually combined first position, said units and their pairs of gripping claws and associated beams are able, to grip and to hold simultaneously a number of closely adjacent sleepers corresponding to the number of units and extending in the same plane, and to lift said sleepers from a sleeper stock or stack located on one side of the railroad bed and lift and move said sleepers towards and over said bed.

During this suspended movement of the thus held sleepers, the aforesaid means is activated so as to allow the units to move away from each other and into a second position in which the units and the sleepers are mutually spaced apart along the railroad bed.

The arrangement also includes means for distributing adjacent units and adjacent sleepers equidistantly.

Equipment utilising a plurality of such arrangements also lies within the scope of the present invention.

BACKGROUND OF THE INVENTION

Several different methods and arrangements of the aforesaid kind are known to the art.

For instance, an appropriate example of the background of the technology relevant at present and the technical field to which the invention relates are found in the contents of the International Patent Application No. PCT/SE98/01992, with the International Publication No. WO-A1-99/24668.

This prior patent application illustrates and describes an arrangement that includes a number of units, each comprising beam-carrying, end-related gripping claws by means of which a number of sleepers chosen for an arrangement along a railroad track can be gripped and released simultaneously.

For a closer understanding of the basic conditions that shall be applied in respect of an arrangement, according to the present invention, the reader is referred primarily to the contents of said patent publication and secondarily to the following overview description given below, with reference to FIG. 1 of the accompanying drawings.

SUMMARY OF THE INVENTION

Technical Problems

When taking into consideration the technical deliberations that a person skilled in this particular art must make in order to provide a solution to one or more technical problems that he/she encounters, it will be seen that on the one hand it is necessary initially to realise the measures and/or the sequence of measures that must be undertaken to this end, and on the other hand to realise which means is/are required in solving one or more of said problems. On this basis, it will be evident that the technical problems listed below are highly relevant to the development of the present invention.

When considering the present standpoint of techniques, as described above, it will be seen that a technical problem resides in the ability to realise the significance of and the advantages afforded by creating an arrangement of the aforesaid kind which can be made lighter than the earlier known equipment described in the aforesaid International Patent Publication while including the same number of units.

A technical problem also resides in the ability to realise the significance of and the advantages afforded by creating with the aid of simple means conditions that will enable a chosen number of sleepers to be placed along a railroad bed with the aid of a much simpler manually applied force than that required in the case of the known technology, such that adjacent sleepers will be spaced equidistantly and capable of being adjusted in dependence of the support that a rail requires with regard to relevant railroad sections.

Another technical problem resides in the ability to realise the significance of and the advantages afforded by providing means which enable the horizontal distance between mutually adjacent units to be increased or reduced with the aid of a beam and associated pairs of gripping claws, and by providing sleepers held by said gripping claws with frame-associated centrally pivotal arms, among other things.

It will also be seen that a technical problem resides in the ability to realise the significance of and the advantages afforded by, inter alia, allowing outer parts of the pivotal arms to co-act pivotally with one end of a respective brace or link, whose other ends are each pivotally fastened to a respective outer-orientated unit.

Another technical problem resides in the ability to realise the significance of and the advantages afforded by pivotally fastening one end of each brace or link to the centre regions of respective pivotal arms, and by pivotally fastening respective other ends of said braces or links to a respective intermediate unit.

It will also be seen that a technical problem resides in the ability to realise the significance of and the advantages afforded by providing the centrally pivotal arms with a common vertical pivot shaft related to the central region of the arms and also to the central region of a frame part.

Another technical problem resides in the ability to realise the significance of and the advantages afforded by including two such arms in the arrangement with the two outer parts of one arm being adapted for pivotal co-action with one end of a respective brace or link and to pivotally fasten the other ends thereof to a respective outer unit.

A technical problem also resides in the ability to realise the significance of and the advantages afforded by enabling the two outer parts of the other arm to co-act pivotally with one end of a respective other brace or link and to pivotally fasten the other ends to a respective outer unit at a chosen distance from the other ends of the braces or links related to said one arm.

Still another technical problem resides in the ability to realise the significance of and the advantages afforded by enabling two central regions of said one arm, on each respective side of the arm pivot axis, to co-act pivotally with one end of a respective brace or link whose other ends are fastened pivotally to a respective one of two intermediate units.

Another technical problem resides in the ability to realise the significance of and the advantages afforded by enabling the two central regions of said other arm, on each respective side of the arm pivot axis, to co-act pivotally with one end of a respective brace or link whose other ends are fastened pivotally to a respective one of said two intermediate units at a distance from the other ends of the braces or links related to said one arm.

Another technical problem resides in the ability to realise the significance of and the advantages afforded by arranging said two arms with their associated eight braces or links equidistantly between chosen pivot points, wherewith two outer units and two intermediate units can be displaced in parallel with one another.

In this regard, it will be seen that a technical problem resides in allowing said two arms and associated braces or links to differ slightly in distance between chosen pivot points, wherewith the two outer units and/or the two intermediate units may be displaceable in a slightly convergent path.

It will also be seen that a technical problem resides in the ability to realise the significance of and the advantages afforded by allowing the braces or links to be rotated to a unit transverse position in a fully combined or closely adjacent position of said units, and to be angled slightly from a perpendicular orientation with said units, and to allow given braces or links to mutually intersect.

It will also be seen that a technical problem resides in the ability to realise the significance of and the advantages afforded by using a hydraulic or a pneumatic piston-cylinder device that is capable of acting between a frame structure and one of said outer units.

It will also be seen that a technical problem resides in the ability to realise the significance of and the advantages that are afforded by enabling displacement of an outer unit relative to the frame structure to be achieved through the agency of movement limiting means that may consist of a rod of adjustable length disposed between stop means related to said rod.

A further technical problem resides in the ability to provide a coordinated array of at least two inventive arrangements that can be positioned side-by-side so as to increase the sleeper laying capacity at least twofold and enable the coordinated arrangements to be actuated synchronously in a coordinated fashion, and to realise the significance of and the advantages afforded by enabling an outer unit of a first arrangement to be placed adjacent an outer unit of a second arrangement, and to position said two units close to one another and to enable said units to mutually co-act through the movement of two mutually pivotal arms and braces or links pivotally fastened thereto.

In the case an array of two identical arrangements, it will be seen that a technical problem resides in realising the significance of and the advantages afforded by choosing said two pivotal arms and the lengths of the braces or links and their pivotal attachments so that the distance between adjacent outer units of a respective arrangement will correspond to the distance between an outer unit and an adjacent intermediate unit with respect to one and/or the other arrangement.

SOLUTION

The present invention takes as its starting point the aforedescribed known technology wherewith an arrangement enables a co-ordinated plurality of sleepers intended for a railroad section to be gripped and released with the aid of pairs of gripping claws which co-act with one of a number of units included in the arrangement and which are co-ordinated with said unit through the agency of a gripping-claw carrying beam.

The arrangement shall be movable and also active between a sleeper stock or stack comprised of a plurality of mutually parallel, loosely stacked and closely adjacent sleepers that can be gripped by gripping claws allocated to the unit or units of said arrangement.

The arrangement includes a means with which the distance between mutually adjacent units and mutually adjacent sleepers can be changed, such as increased, wherewith pairs of gripping claws on one unit are adapted to grip a respective sleeper with an end-orientated or end-related clamping action to move the sleepers through a distance corresponding to a chosen sleeper distance appropriate for a chosen railroad bed, at which position the gripping claws in the units are opened above the railroad bed and therewith release said plurality of sleepers.

Said means are co-ordinated to form an arrangement frame structure.

With the intention of solving one or more of the aforesaid technical problems, it is particularly proposed in accordance with the present invention that the known technology shall be supplemented by giving said means the form of frame-associated and centrally pivotal arms, whose outer portions are capable of pivotally co-acting with one end of a respective brace or link whose other ends are pivotally fastened to a respective outer unit.

It is also proposed that one end of a respective brace or link is pivotally fastened to the midway regions of the arms on respective sides of a central pivot point, and that the other ends are pivotally fastened to a respective intermediate unit.

By way of proposed embodiments that lie within the scope of the basic concept of the present invention, it is proposed that the centrally pivotal arms are allocated a common, vertically orientated, pivot axis related to said frame part.

It is also proposed that the arms are two in number with both outer arm portions of one arm pivotally co-acting with one end of a respective brace or link whose other ends are pivotally fastened to a respective outer unit.

It is also proposed that both outer arm portions of the other arm pivotally co-act with the end of a respective other brace or link whose other ends are pivotally fastened to a respective outer unit at a distance from the other ends of the braces or links related to said one arm.

It is also proposed that the central regions of one arm on respective sides of the pivot axis are able to co-act pivotally with one end of a respective brace or link whose other ends are pivotally fastened to a respective intermediate unit.

It is also proposed that the central regions of the other arm on respective sides of the pivot axis are able to co-act pivotally with one end of a respective brace or link whose other ends are pivotally fastened to a respective intermediate beam at a distance from the other ends of the braces or links related to said one arm.

It is also proposed, in accordance with the invention, that said two arms, with associated braces or links, shall be capable of being given the same distance between chosen pivot points, and that two outer units and two intermediate units can be displaced in parallel.

It is also proposed that said two arms, with associated braces or links, shall be capable of being given a slightly deviating distance between chosen pivot points and that said two outer units and/or said two intermediate units can be displaced in a slightly convergent part relative to one another.

It is also proposed, in accordance with the invention, that the braces or links are rotatable to a transverse position of the units, also when the units are in a fully juxtaposed position, and therewith be angled slightly from a perpendicular orientation relative to said units and intersect one another.

Also proposed in accordance with the invention is the use of a hydraulic or a pneumatic piston-cylinder device which is able to act between the frame structure and one of said outer units.

In addition, there is proposed in accordance with the invention means functioning to limit displacement of an outer unit relative to said frame structure, wherein said means may consist of a rod whose length can be adjusted between rod-related stop means.

Also proposed in accordance with the invention is the possibility of constructing an array of two or more co-ordinated arrangements, said arrangements in said array being positioned side-by-side such as to obtain a greater sleeper-laying capacity.

It is proposed in this regard that an outer unit of a first arrangement can be placed adjacent to and parallel with an outer unit of a second arrangement and that these units are placed adjacent each other and able to co-act mutually through the agency of two mutually pivotal arms and also through the agency of braces or links related to said arms.

With regard to said array of arrangements, it is proposed in accordance with the invention that the lengths of the two pivotal arms and the lengths of the braces or links and the pivotal attachments are chosen so that the distance between adjacent outer units in respective arrangements will correspond to the distance between an outer unit and an adjacent intermediate unit in respect of one and/or the other arrangement.

ADVANTAGES

Those advantages primarily afforded by the present invention and its particular significant characteristic features reside in the provision of conditions with which the weight of an arrangement of this kind can be reduced, and therewith facilitate manual manoeuvring of sleepers that are held firmly in said units and that shall be placed with precision over a prepared railroad bed, and wherewith the relative distance between adjacent sleepers can be readily adjusted in accordance with expected loading conditions acting on the railroad bed concerned.

Other advantages include simplifications whereby means adapted to enable the horizontal distance between adjacent units, comprising a beam and gripping claws co-ordinated therewith, and adjacent sleepers comprises two frame-associated centrally pivotal arms whose outer parts are able to co-act pivotally with one end of a respective brace or link whose other ends are pivotally fastened to a respective outer unit.

One end of a respective brace or link is also pivotally fastened to the midway regions of said two arms on a respective side of a central pivot axis and the other ends of said respective braces or links are pivotally fastened to a respective intermediate unit.

Arrangements of this kind are well suited for inclusion as units in said array.

The primary characteristic features of the present invention are set forth in the characterising clause of the accompanying Claim 1, whereas the features set forth in the characterising clause of the accompanying Claim 15 can be considered to characterise an array of said arrangements.

BRIEF DESCRIPTION OF THE DRAWINGS

Earlier known equipment for moving sleepers from a sleeper stock to a railroad bed and an exemplifying embodiment of an arrangement at present preferred and having characteristic features significant of the present invention will now be described in more detail with reference to the accompanying drawings, in which.

DESCRIPTION OF KNOWN TECHNOLOGY

Figure 1:
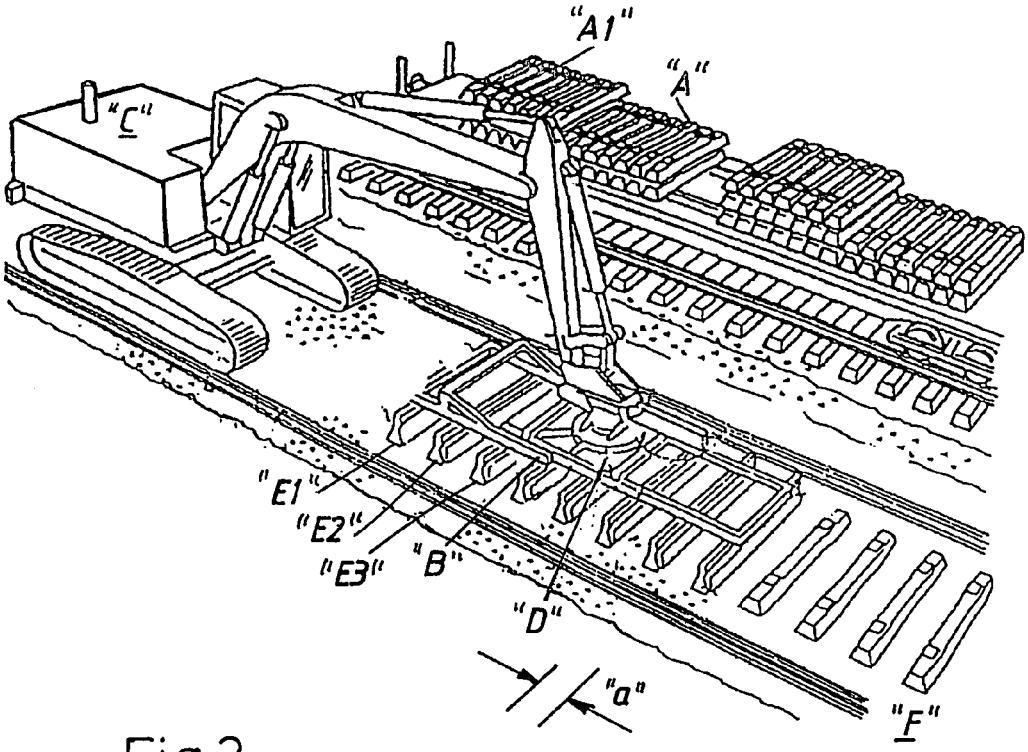
FIG. 1 is a perspective view of earlier known equipment according to what is shown and described in the International Patent Application Serial No. PCT/SE98/01992.

FIG. 1 is a perspective view of equipment illustrated and described in more detail in the aforesaid International Patent Application No. PCT/SE98/01992, where the illustrated equipment is intended to grip or release a plurality of co-ordinated sleepers intended for placement along a railroad section with the aid of pairs of gripping claws related to a claw-carrying beam.

Shown in FIG. 1 is a sleeper stock or stack "A" comprising a plurality of co-ordinated and mutually parallel loose and closely adjacent sleepers of which groups "A1" can be gripped by said arrangement "B".

In this case, the arrangement "B" is carried by a working machine "C" and the arrangement includes means "D" capable of increasing the distance between mutually adjacent sleepers "E1; E2; E3 . . . ".

The arrangement also includes pairs of gripping claws that are adapted to firmly hold respective sleepers with an end-related clamping action.

The distance "a" between adjacent sleepers can be adjusted to a sleeper spacing appropriate with regard to a railroad bed "F" and the gripping claws are opened to release the co-ordinated sleepers in this position.

More particularly, FIG. 1 shows that pair-wise gripping claws with associated beam are adapted to grip and firmly hold a plurality of closely packed, group-sorted sleepers "A1", that extend in one and the same plane, in a first position above the sleeper stock "A", and to lift said group of sleepers with the aid of the working machine "C" and move the sleepers hanging from said claws towards and over the railroad bed "F" while increasing the spacing between the sleepers towards and up to a second position in which the distance between the gripped sleepers has been "increased" with the aid of the beams carrying said claws.

When the spacing between the sleepers has been increased, the sleepers are placed to rest on the railroad bed and released.

DESCRIPTION OF EMBODIMENTS AT PRESENT PREFERRED

It is pointed out initially that we have chosen to use in the following description of embodiments at present preferred and including significant characteristic features of the invention illustrated in the figures of the accompanying drawings special terms and terminology with the primary intention of illustrating the inventive concept more clearly.

However, it will be noted that the expressions and terms used shall not be seen as being limited solely to these expressions and terms and that each chosen expression and term shall be interpreted as also including all technical equivalents that function in at least essentially the same way so as to achieve the same or essentially the same intention and/or technical effect.

Figure 2:
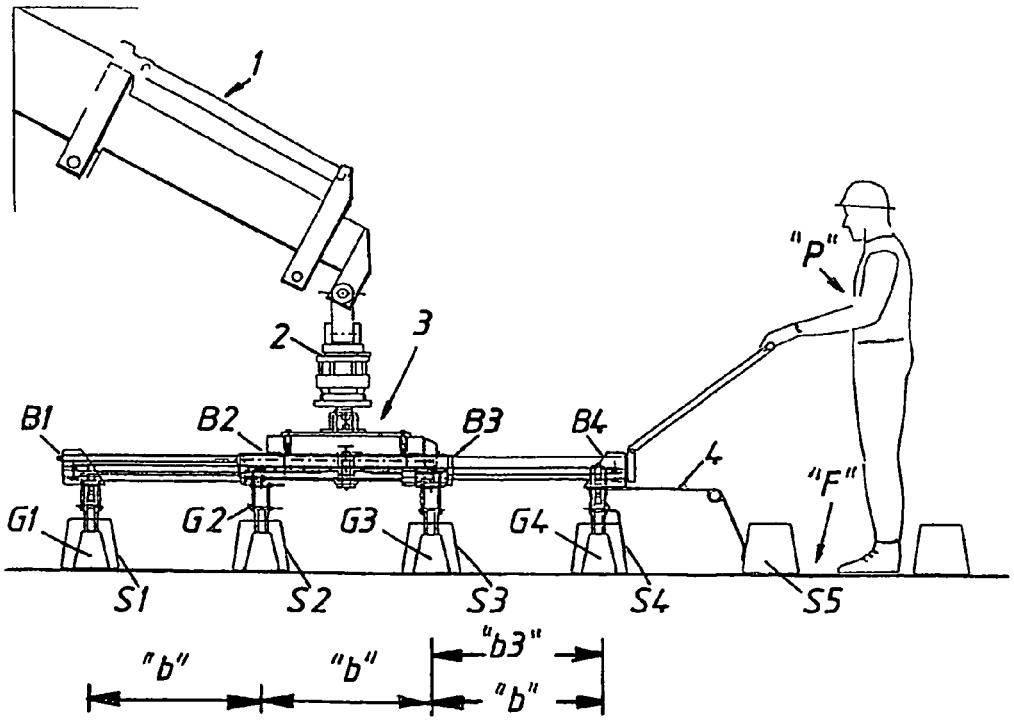
FIG. 2 is a first side view of an arrangement according to the present invention, where four sleepers are shown to be held firmly by four units and spaced apart for positioning over a railroad bed, where manoeuvring and adjustment of the arrangement with the sleepers held over the bed is effected inter alia, with the aid of a person standing on the bed.

FIG. 2 is a schematic illustration of the fundamental conditions or prerequisites of the present invention, in which the significant properties of the invention are generally concretised in the embodiment described below and at present proposed.

As will be seen in FIG. 2, there is used a crane arm 1 that includes an attachment means for holding an arrangement 3 constructed in accordance with the directives relating to the present invention.

The arrangement 3 is shown here in a first side view and is constructed to enable four sleepers to be securely held simultaneously with the aid of four units in an adapted co-ordinated or increased distance therebetween.

In the case of the FIG. 2 illustration, the distance between the sleepers has been increased and the sleepers have been referenced S1, S2, S3 and S4 respectively and are held firmly by four units B1, B2, B3 and B4 by virtue of an end-related clamping action between pairs of gripping claws G1, G2, G3 and G4 respectively with the aid of a beam or beam construction carrying said gripping claws.

A person "P" stands on the railroad bed "F" and the positions of respective sleepers S1, S2, S3 and S4 along the railroad bed is controlled by a crane driver, wherewith the distance of the sleeper S4 from an already positioned sleeper S5 can be caused to correspond to a chosen distance "b3" between sleeper S3 and the sleeper S4 with the aid of a distance measuring unit 4.

The invention is based on the concept of causing each distance "b" chosen between the sleepers S3 and S4 to be the same as the distance between remaining sleepers S1 and S2, S2 and S3.

The construction of the arrangement 3 will be described below in more detail.

Figure 3:
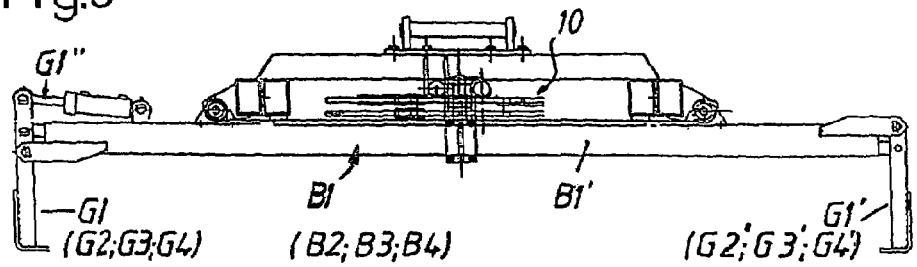
FIG. 3 is a second side view of the inventive arrangement, although in the absence of sleeper co-action.

Thus, FIG. 3 is a side view of the arrangement 3, although only one unit B1 is shown.

As shown in FIG. 3, the unit B1 carries mutually opposing gripping claws referenced G1 and G1', of which the gripping claw G1' is shown to be fixed to a beam B1', whereas the gripping claw G1 can be rotated or pivoted from the gripping and holding position shown in FIG. 3 to a release position not shown in said figure, with the aid of a piston-cylinder device G1".

Figure 4:
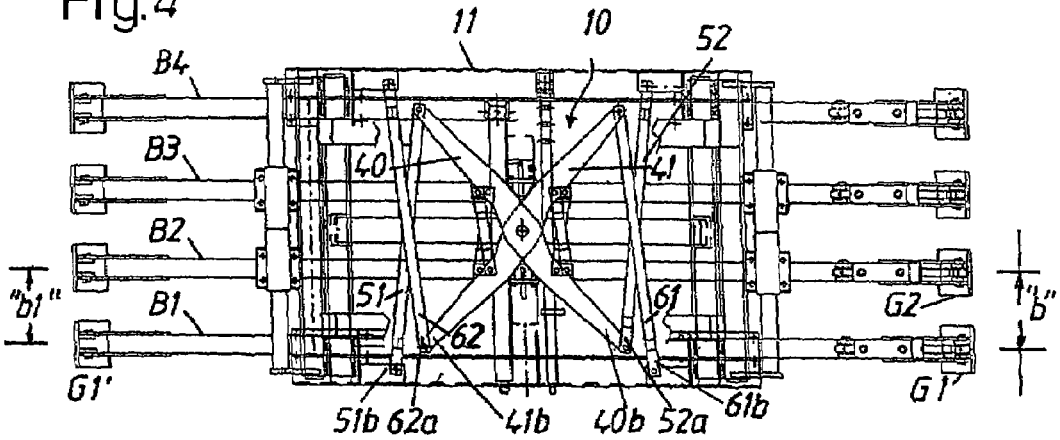
FIG. 4 is a plan view of the arrangement shown in FIG. 3, wherein the arrangement includes four units, each having pairs of gripping claws and associated beams and shown in a combined or brought-together state.

Referring to FIG. 4, there is shown means 10, which forms part of the arrangement and which is able to adjust selectively the horizontal distance "b" between the units B1 and B2 and between remaining units B2 to B3 and B3 to B4 from a first co-ordinated and fully combined or closely juxtaposed position "B1" (FIG. 4) to a second position "B2" in which the distance between the units has been increased and said units fully moved apart (FIG. 7) and vice versa.

In conjunction with moving co-ordinated and gripped sleepers "A1" belonging to the sleeper stock or stack, the means 10 is activated to increase the distance between adjacent units B1, B2, B3 and B4 and adjacent sleepers, wherewith unit-associated pairs of gripping claws G1, G1' are adapted to secure a respective sleeper through the medium of an end-related clamping action until a distance corresponding to a sleeper spacing "b3" according to FIG. 2, suitable for a railroad bed "F", is reached, wherewith the gripping claws of respective units can be opened in this position to release said plurality of sleepers.

The sleepers have been omitted in FIGS. 3 to 12, for the sake of clarity.

The means 10 is comprised of a frame structure 11 (not described in detail) and centrally pivotal arms 40, 41 whose respective outer arm portions 40*a*, 40*b* and 41*a*, 41*b* respectively co-act pivotally with one end of a respective brace or link.

Thus, one end 40*a* of the arm 40 co-acts with a brace or a link 51, while the other end 40*b* of said arm co-acts with a brace or a link 52.

Figure 5:
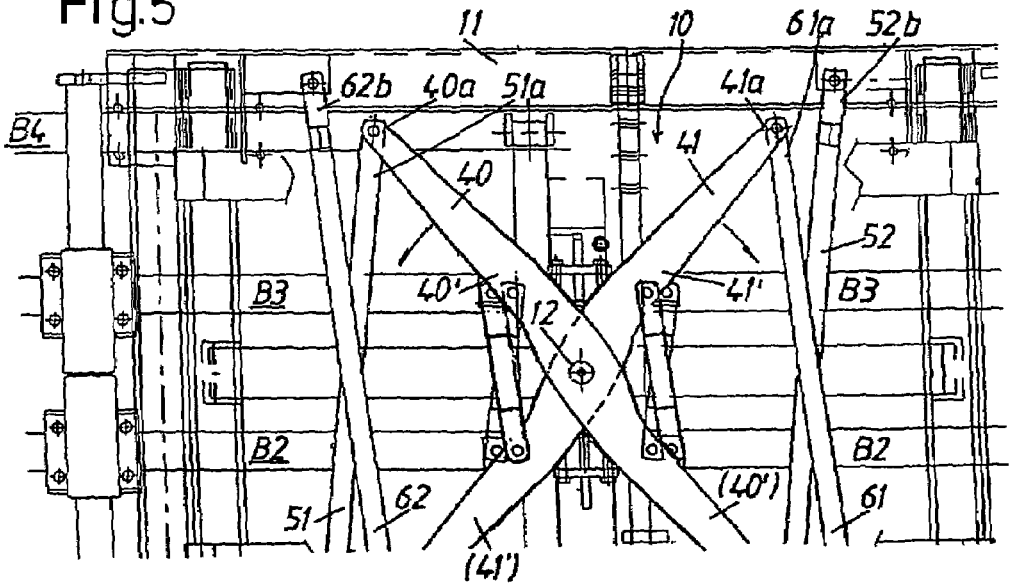
FIG. 5 illustrates in a slightly larger scale a central part of the arrangement taking the position shown in FIG. 4.

Referring to FIGS. 4 and 5, it will be seen that one end 51*a* of the link 51 co-acts pivotally with one end 40*a* of the arm 40, whereas the other end 51*b* of the link 51 is pivotally fastened to and co-acts with an outermost unit B1.

Similarly, the other end 40*b* of the arm 40 is connected pivotally to one end 52*a* of the brace or the link 52, whereas the other end 52*b* of the link 52 is fastened pivotally to an outermost unit B4.

One end 41*a* of the arm 41 co-acts pivotally with one end 61*a* of the link 61, whereas the other end 61*b* of said link 61 is fastened pivotally to the unit B1.

The other end 41*b* of the arm 41 is fastened pivotally to one end 62*a* of the link 62, whereas the other end 62*b* of said link 61 is fastened pivotally to the unit 64.

As will be seen, the arms 40, 41 are pivotally mounted about a common pivot axis 12 disposed in the midway regions of respective arms.

Figure 8:
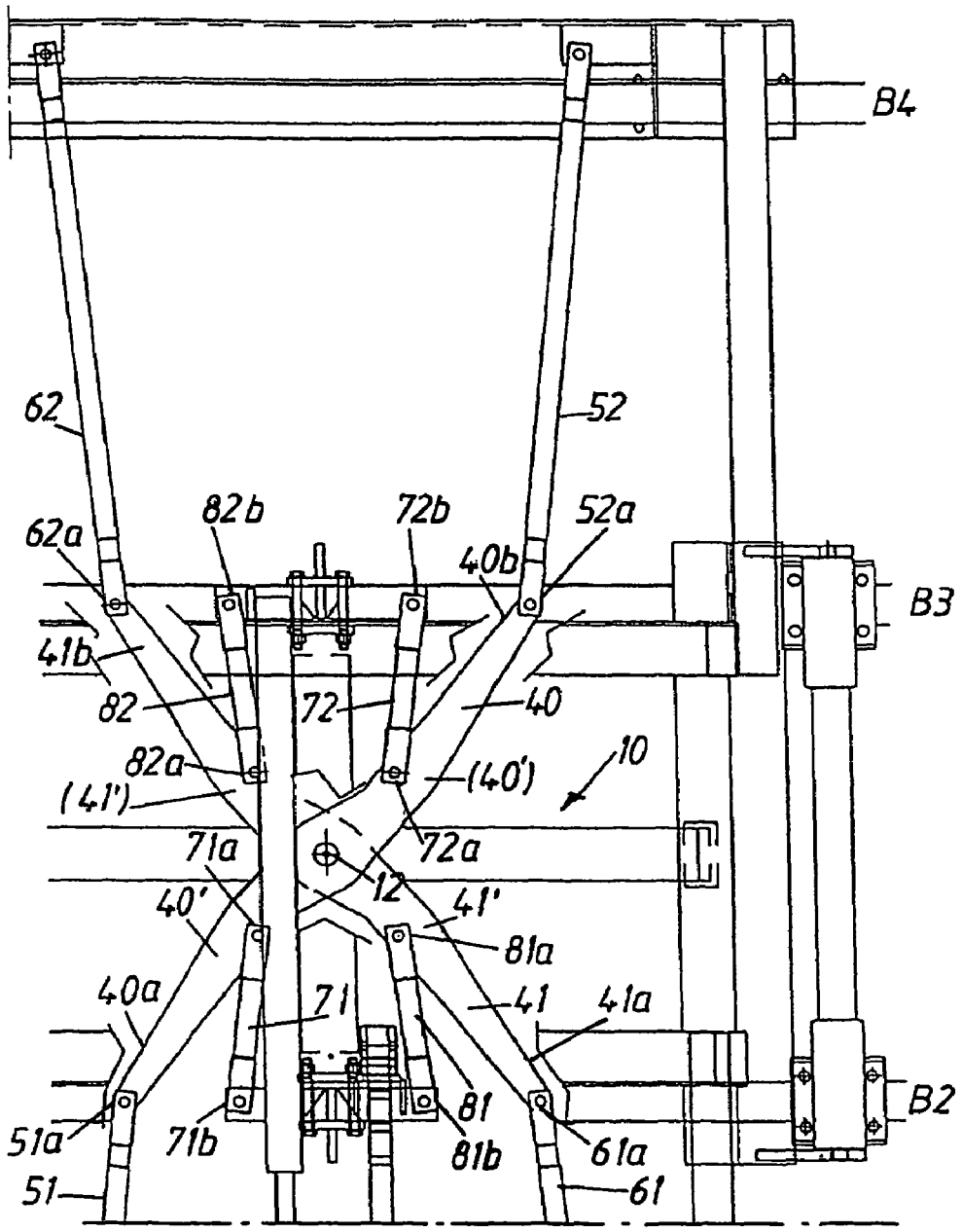
FIG. 8 shows in a slightly larger scale a central part of the arrangement in the position shown in FIG. 6.

With reference to FIGS. 5 and 8, it will be seen that one end of said links is pivotally fastened to a midway or central region 40', (40') and 41', (41') of the arms 40 and 41 on a respective side of the pivot axis 12, whereas the other ends of said links are fastened to intermediate units B2 and B3 respectively.

This is shown more clearly in FIG. 8.

Thus, one end 71*a* of a link 71 is pivotally fastened to one central region 40' of the arm 40, and the other end 71*b* of said link is pivotally fastened to the unit B2.

As will be seen, one end 72*a* of a link 72 is pivotally fastened to the other central region (40') of the arm 40, and the other end 72*b* of said link is pivotally fastened to the unit B3.

It will also be seen that one end 81*a* of a link 81 is pivotally fastened to one central region 41' of the arm 41, and that the other end 81*b* of said link is pivotally fastened to the unit B2.

It will also be seen that one end 82*a* of a link 82 is pivotally fastened to another central region 41' of the arm 41, and that the other end 82*b* of said link is pivotally fastened to the unit B3.

In the illustrated embodiment, the pivotal arms 40, 41 are two in number with the outer arm portions 40*a*, 40*b* of one arm 40 co-acting pivotally with one end 51*a*, 52*a* of a respective brace of link 51, 52, wherewith the other ends 51*b* and 52*b* of said brace or link are pivotally fastened to a respective outer unit B1 and B4.

The outer arm portions 41*a*, 41*b* of the other arm 41 co-act pivotally with one end 61*a*, 62*a* of a respective other brace or link 61, 62, wherein the other ends 61*b*, 62*b* of said brace or link 61, 62 are fastened to a respective outer unit B1 and B4 at a distance "c" from said other ends 51*b* and 52*b* of the braces or links 51 and 52 related to said one arm 40.

The two central regions 40', (40') of said one arm 40 co-act pivotally with one end of a respective brace or link 71, 72, wherewith other ends are pivotally fastened to a respective intermediate unit.

Two central regions 41', (41') of said other arm (41) co-act pivotally with one end of a respective brace or link (81, 82), the other ends of which are fastened pivotally to a respective intermediate unit B2 and B3 at a distance from said other end of the braces or links related to said one arm 40.

The two arms 40, 41, with associated braces or links, are spaced at the same distance apart between chosen link pivot points, therewith enabling two outer units and two intermediate units to be moved towards and away from each other in a parallel path.

It also lies within the scope of the invention to use two arms 40 41, with associated braces or links, that are disposed at a slightly deviating distance between selected pivot points, therewith enabling said two outer units and/or said two intermediate units to be moved in a slightly converging path.

As will be seen from FIGS. 4 and 5, when the units B1, B2, B3 and B4, with associated gripping claws, are in a fully combined position, the braces or links 51, 52; 61, 62; 71, 72; 81, 82, are pivoted to a position in which the units B1 to B4 are transversely orientated, or transversely positioned, and angled at generally a right angle from a longitudinally extending orientation of said units and overlap each other pair-wise, meaning that they are active in different planes.

Figure 6:
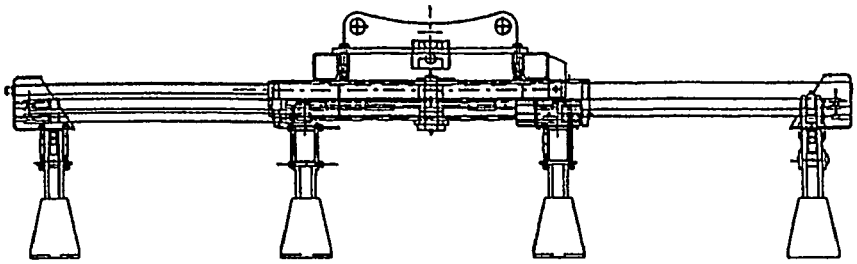
FIG. 6 is a first side view of the inventive arrangement, where four units having pairs of gripping claws and associated beams are shown at a greater distance apart in relation to the FIG. 4 illustration.
Figure 7:
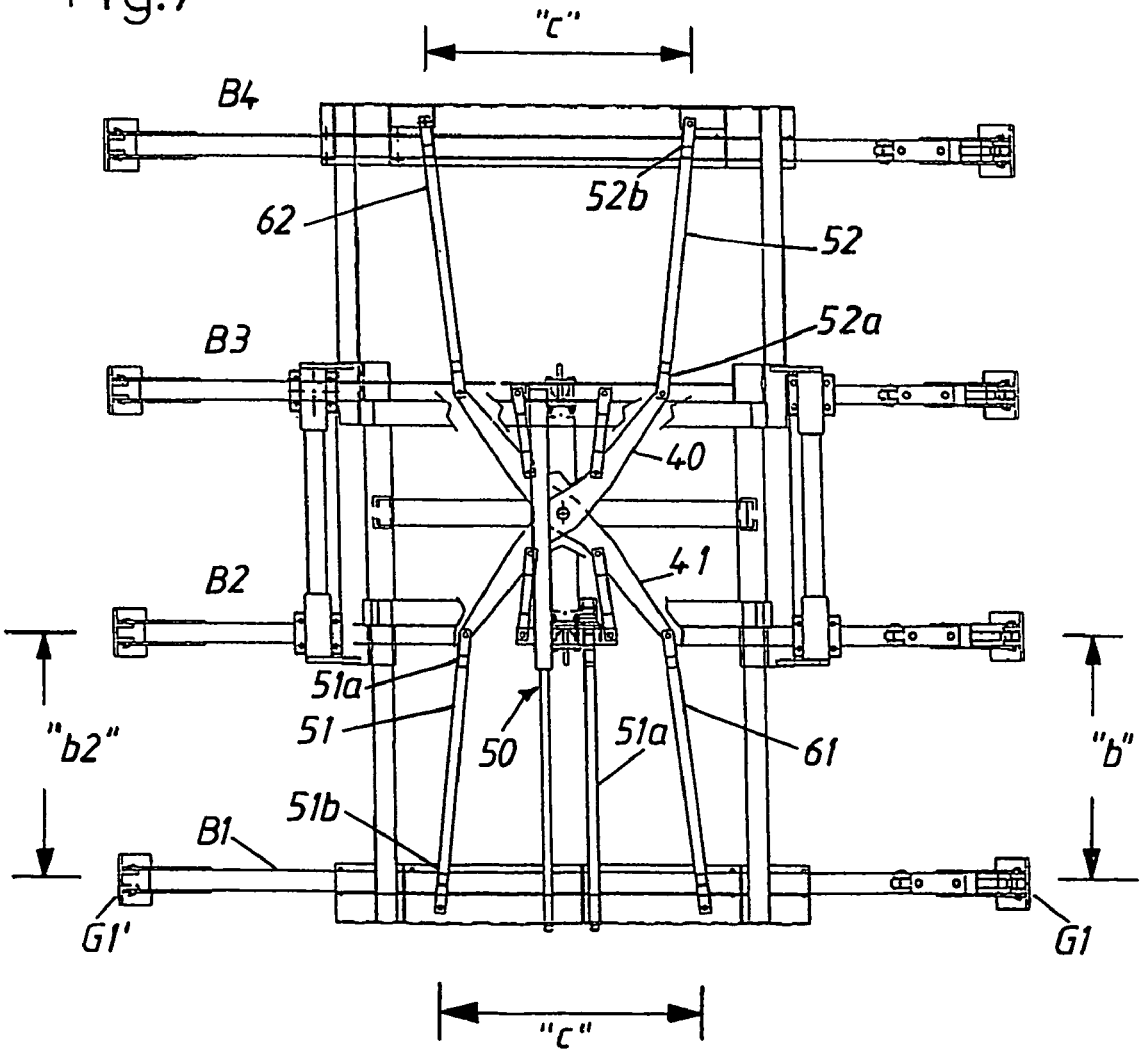
FIG. 7 is a plan view of the arrangement, in which the units, with pair-wise gripping claws and associated beams, are shown in said greater distance apart.

FIG. 6 illustrates together with FIGS. 7 and 8 a position in which the units B1 to B4, with pair-wise gripping claws and with associated beams, take a greater distance between the sleepers than that taken in the FIG. 2 illustration.

It will be seen from these figures, and then particularly from FIG. 7, that the arrangement includes a hydraulic or a pneumatic piston-cylinder device 50 which is adapted to act between the frame structure 11 and one of the outer units, such as the unit B1.

FIG. 7 also illustrates in particular the orientation taken by the arms 40 and 41 together with allocated braces or links 51, 52; 61, 62; 71, 72 and 81, 82.

The orientation of these braces and links is shown more clearly in the enlarged view of FIG. 8, where no braces or links overlap each other.

The arrangement also includes means 50*a* for restricting displacement of an outer unit B1 relative to the frame structure 11, said means 50*a* having the form of a rod whose length can be adjusted between associated stop elements so as to enable the units to be spaced equidistantly by a chosen distance "b2".

Figure 9:
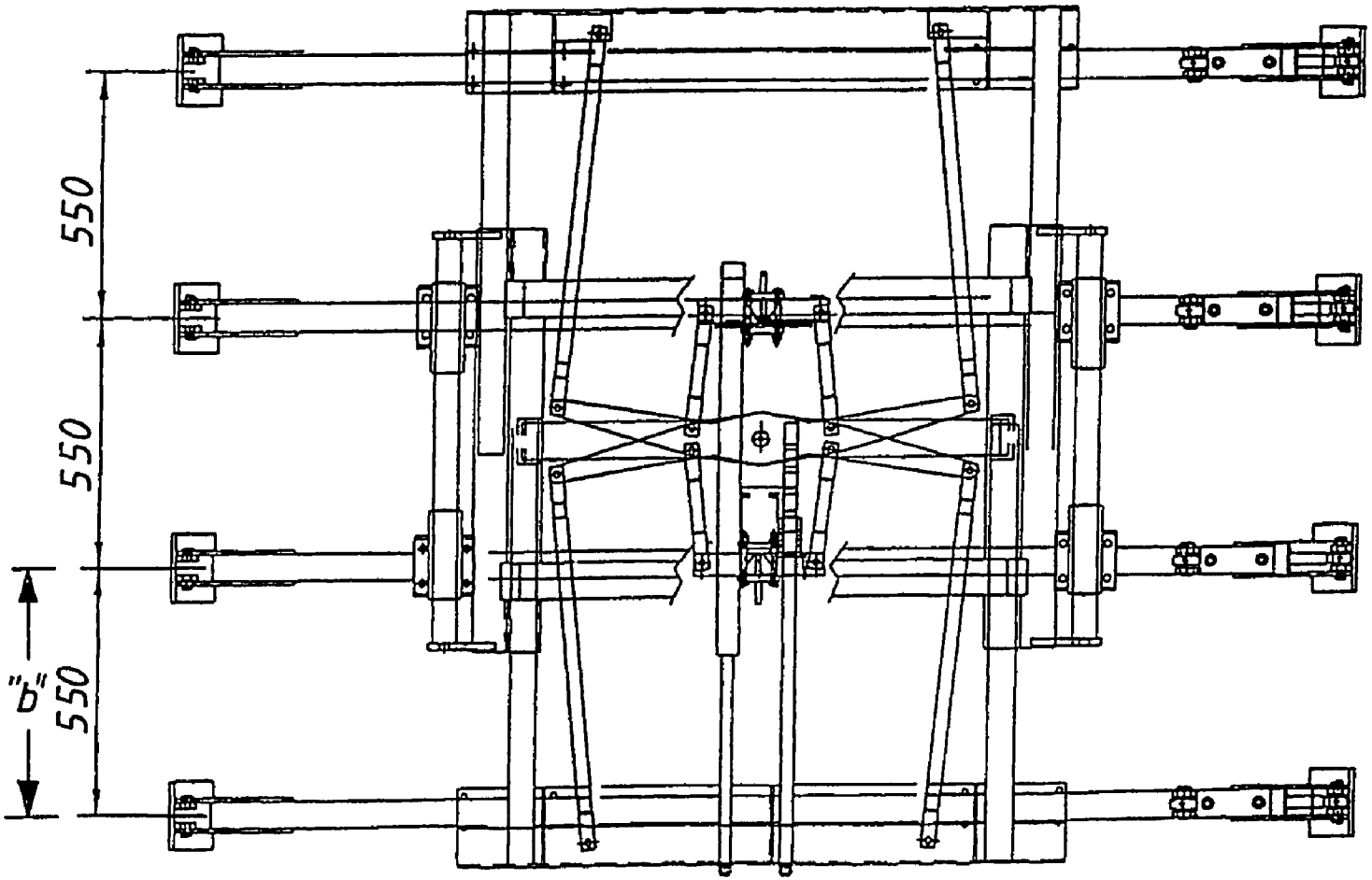
FIG. 9 is a plan view of the arrangement showing the units in an intermediately-orientated greater distance apart adapted for denser sleeper orientation than that shown in FIG. 7.

FIG. 9 illustrates a state of the arrangement in which the means 10 and the units B1 and B4 are located in an "intermediate position" in which the distance "b" is adapted to a value of 550 mm.

It will be noted that displacement of the units B1 to B4 inclusive while retaining one and the same increasing or decreasing distance "b" between said units requires corresponding dimensioning of the means 10.

For example, with reference to FIG. 7, a first distance between the common pivot points 12 of the arms 40 to 41 and the pivotal fastening 71*a* and 72*a* and 81*a* and 82*a* in respect of a first brace or link shall have mutually the same value.

A second distance between the common pivot point 12 of the arms 40 and 41 and respective pivotal fastening 51*a*, 52*a* and 61*a* and 62*a* in respect of second braces or links shall also have the same value.

In respect of parallel displacement, the ratio of the first distance to the second distance shall be 1:3.

Figure 10:
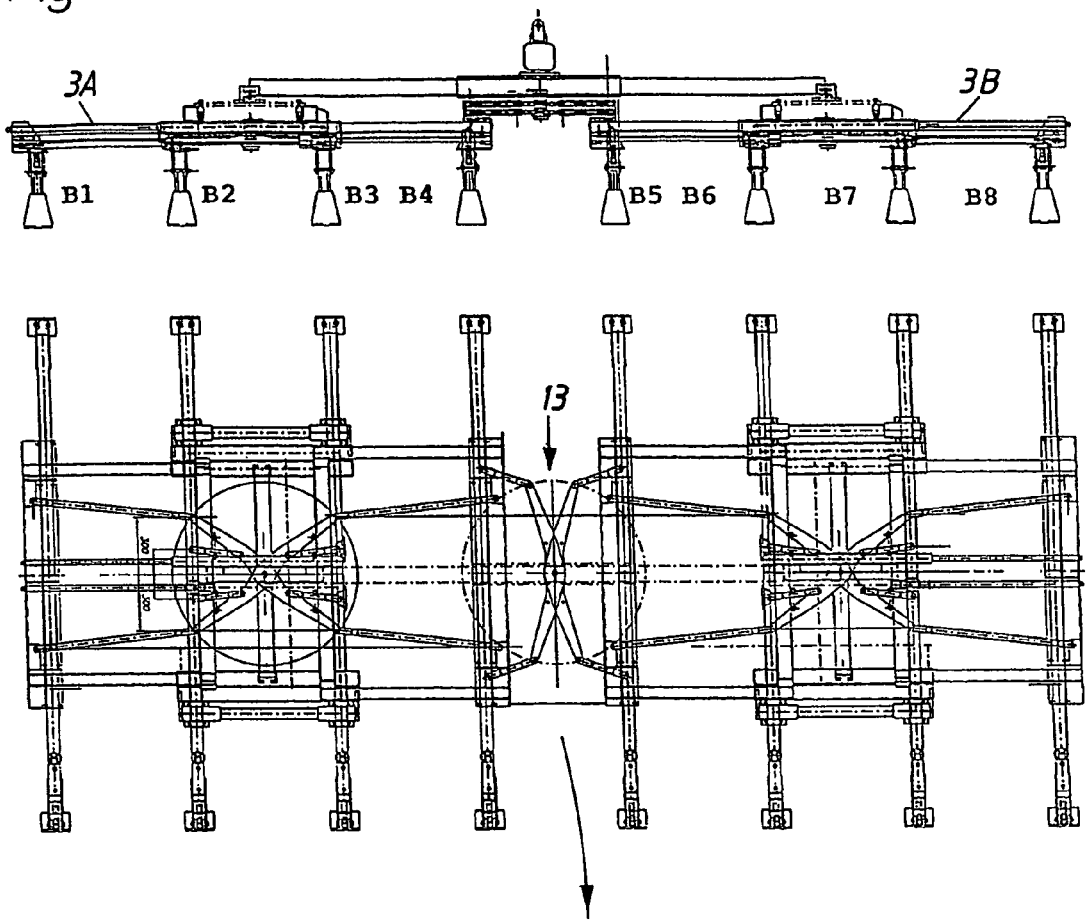
FIG. 10 is a first side view of an array comprising two co-ordinated arrangements positioned side-by-side in accordance with the invention, with an increased distance between the units.
Figure 11:
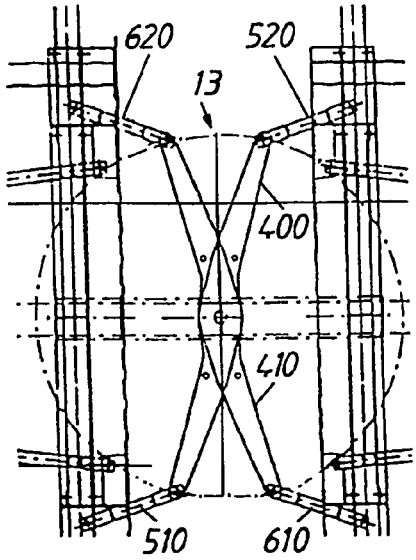
FIG. 11 is a plan view of the array according to FIG. 9.

FIGS. 10 and 11 illustrate a development of the present invention where two arrangements 3A and 3B of the aforedescribed kind are coupled together to form an array, in which the arrangement 3A and 3B are located side-by-side with the number of co-ordinated units B1, B2, B3 and B4 in one arrangement 3A being increased with further co-ordinated units B5, B6, B7 and B8 in a second arrangement 3B.

In this regard, it is particularly proposed that an outer unit B4 in a first arrangement 3A can be placed adjacent an outer unit B5 of a second arrangement 3B and that these units lie close together and co-act with each other through the agency of an intermediate coupling means 13 that includes arms 400 and 410 that are pivotal relative to each other via four braces or links referenced 510, 520; 610, 620.

As shown more specifically in FIG. 11, the pivotal arm 400, 410 and the lengths of the braces or links and respective pivotal attachment are chosen so that the distance between mutually adjacent outer units B4, B5 of respective arrangements 3A and 3B will correspond to the distance between an outer unit B4 and an adjacent intermediate unit B3 in respect of one arrangement 3A or the other arrangement 3B.

Figure 12:
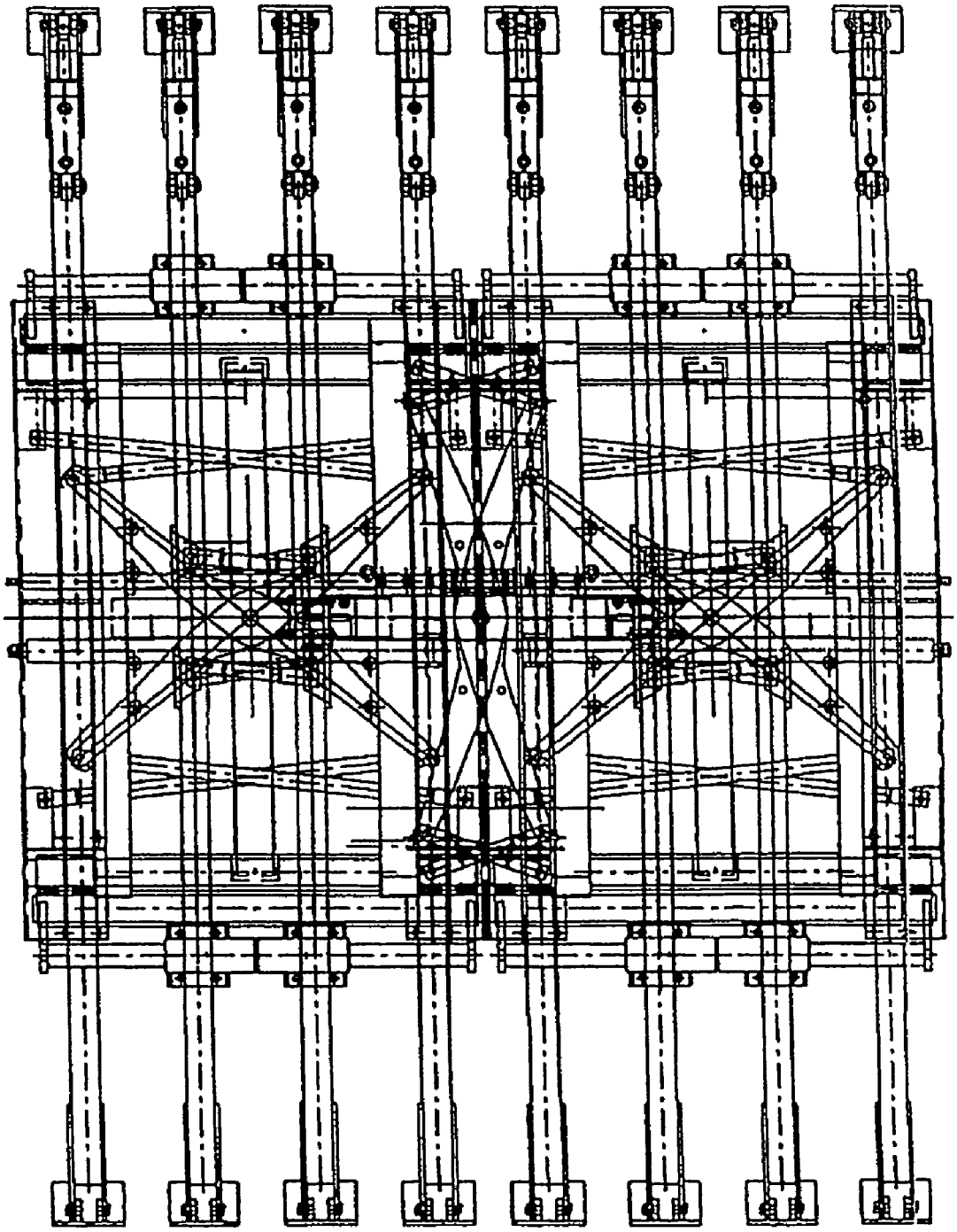
FIG. 12 illustrates the array shown in FIG. 10 in a fully compacted state.

FIGS. 10 and 11 illustrate the array in which spacing of the units is increased, whereas FIG. 12 illustrate the array when the units have been brought together or combined.

It will be understood that the invention is not restricted to the aforedescribed and illustrated exemplifying embodiment thereof and that modifications can be made within the scope of the inventive concept and illustrated in the accompanying Claims.

It will also be understood in particular that each illustrated unit can be combined with each other illustrated unit within the concept of the invention in order to achieve a desired technical function.

The invention claimed is:

1. An arrangement with which a plurality of sleepers intended for a railroad section can be gripped and released with the aid of a plurality of units from gripping claws carried in pairs by a beam structure, wherein a plurality of mutually parallel and loosely stacked closely adjacent sleepers can be gripped by an arrangement-associated unit, wherein the arrangement includes means for increasing or decreasing the distance between adjacent units and adjacent sleepers, wherein pairs of gripping claws in a unit are adapted to hold a respective sleeper firmly through the medium of an end-orientated clamping action, wherein the arrangement is adapted to move a respective sleeper through a distance corresponding to a unit spacing or sleeper spacing suitable for a railroad bed and to open said unit-associated gripping claws in this position so as to release said plurality of sleepers, wherein said means has the form a frame structure, wherein said units are adapted to grip and firmly hold a plurality of closely adjacent sleepers extending in one and the same plane when said units are in a combined first position and to lift said sleepers and move the same towards and over the railroad bed and distribute said units and the sleepers held thereby to a desired sleeper spacing, and wherein said arrangement also includes means for spacing adjacent units and sleepers equidistantly, wherein said means (10) includes frame-associated and centrally pivotal arms (40, 41) whose outer arm portions (40*a*, 40*b*; 41*a*, 41*b*) co-act pivotally with one end of a respective brace or link (51, 52; 61, 62) whose respective other ends are pivotally fastened to a respective outer unit (B1, B4); and in that one end of a respective brace or link (71, 72; 81, 82) is pivotally fastened to central regions (40', (40'); 41', (41')) of the arm, whereas the other ends of said respective brace or link are pivotally fastened to a respective intermediate unit (B2, B3).

2. An arrangement according to claim 1, wherein said centrally pivotal arms are allocated a common vertical pivot axis (12) related to a frame part (11).

3. An arrangement according to claim 1, wherein the arms (40, 41) are two in number with the outer arm portions of one arm co-acting pivotally with one end of a respective brace or link, the other ends of which are pivotally fastened to a respective outer unit.

4. An arrangement according to claim 1, wherein the arms are two in number with the outer parts of the other arm (41) pivotally co-acting with one end of a respective other brace or link, the other ends of which are fastened to a respective outer unit at a distance from the other ends of said brace or links in relation to said one arm (40).

5. An arrangement according to claim 1, wherein the arms are two in number with the central regions of one arm co-acting pivotally with one end of a respective brace or link whose other ends are pivotally fastened to a respective intermediate unit.

6. An arrangement according to claim 1, wherein the arms are two in number with the central regions of the other arm co-acting pivotally with one end of a respective brace or link whose other ends are pivotally fastened to a respective intermediate unit at a distance from said other ends of the braces or the links related to said one arm (40).

7. An arrangement according to claim 1, wherein two arms with associated braces or links include equidistantly spaced chosen pivot points, therewith enabling two outer units and two intermediate units to be displaced in parallel.

8. An arrangement according to claim 1, wherein two arms, with associated braces or links, are allocated slightly deviating distances between chosen pivot points, wherewith the two outer units and/or the two intermediate units are movable in a converging path.

9. An arrangement according to claim 1, wherein when the units including said gripping claws are combined or located close together, said braces or links are rotated to a position in which the units are transversely located and are angled essentially at right angles from a longitudinally extending unit orientation.

10. An arrangement according to claim 1, wherein the arrangement includes a hydraulic or a pneumatic piston-cylinder device (50) adapted to act between a frame structure and one of said outer units.

11. An arrangement according to claim 1, comprising means (50*a*) for limiting displacement of an outer unit relative to a frame structure, said means (50*a*) having the form of a rod whose length can be adjusted between rod-related stop means.

12. An arrangement according to claim 1, wherein a first distances between the common pivot point (12) of the arms and the pivotal attachments of first braces or links are of mutually equal values.

13. An arrangement according to claim 1, wherein a second distance between common pivot points of the arms and the pivotal attachments of second braces or links are mutually of the same value.

14. An arrangement according to claim 13, wherein the ratio between the first distance and the second distance is 1:3.

15. An array comprising juxtaposed arrangements according to claim 1, wherein an outer unit of a first arrangement can be placed adjacent an outer unit of a second arrangement, said units being located adjacent one another and co-acting mutually through the agency of pivotal arms and via braces or links.

16. An array according to claim 15, wherein the lengths of the pivotal arms and braces or links and said pivotal attachments are chosen so that the distance between adjacent outer units of respective arrangements will correspond to the distance between an outer unit and an adjacent intermediate unit of one arrangement or the other.

17. An arrangement according to claim 2, wherein the arms (40, 41) are two in number with the outer arm portions of one arm co-acting pivotally with one end of a respective brace or link, the other ends of which are pivotally fastened to a respective outer unit.

18. An arrangement according to claim 2, wherein the arms are two in number with the outer parts of the other arm (41) pivotally co-acting with one end of a respective other brace or link, the other ends of which are fastened to a respective outer unit at a distance from the other ends of said brace or links in relation to said one arm (40).

19. An arrangement according to claim 3, wherein the arms are two in number with the outer parts of the other arm (41) pivotally co-acting with one end of a respective other brace or link, the other ends of which are fastened to a respective outer unit at a distance from the other ends of said brace or links in relation to said one arm (40).

20. An arrangement according to claim 17, wherein the arms are two in number with the outer parts of the other arm (41) pivotally co-acting with one end of a respective other brace or link, the other ends of which are fastened to a respective outer unit at a distance from the other ends of said brace or links in relation to said one arm (40).

* * * * *